US006027783A

United States Patent [19]

Wagener

[11] Patent Number: 6,027,783

[45] Date of Patent: Feb. 22, 2000

[54] PROCESS FOR MANUFACTURING A FLAT ELEMENT WITH INTERRUPTED MULTIFILAMENTS

[75] Inventor: Gert Wagener, Emsdetten, Germany

[73] Assignee: Saertex Wagener GmbH, Saerbeck, Germany

[21] Appl. No.: 09/068,232

[22] PCT Filed: Apr. 17, 1997

[86] PCT No.: PCT/DE97/00784

§ 371 Date: May 6, 1998

§ 102(e) Date: May 6, 1998

[87] PCT Pub. No.: WO97/48845

PCT Pub. Date: Dec. 24, 1997

[30] Foreign Application Priority Data

Jun. 18, 1996 [DE] Germany ..... 196 24 234

[51] Int. Cl.[7] ..... B32B 5/12; B32B 5/06

[52] U.S. Cl. ..... 428/105; 428/115; 28/107

[58] Field of Search ..... 28/107; 428/196, 428/105, 115

[56] References Cited

U.S. PATENT DOCUMENTS

| | | | |
|---|---|---|---|
| 5,018,255 | 5/1991 | Bolliand . | |
| 5,456,981 | 10/1995 | Olry et al. . | |
| 5,688,577 | 11/1997 | Smith et al. | 428/113 |

FOREIGN PATENT DOCUMENTS

| | | |
|---|---|---|
| 0 528 336 | 2/1993 | European Pat. Off. . |
| WO 91 01397 | 2/1991 | WIPO . |
| WO 91 08332 | 6/1991 | WIPO . |
| WO 97/04946 | 2/1997 | WIPO . |

*Primary Examiner*—Christopher Raimund
*Attorney, Agent, or Firm*—Merchant & Gould P.C.

[57] ABSTRACT

The invention proposes to provide interrupted individual filaments by a subsequent treatment in a flat element made of aligned filaments. Also disclosed is a process for manufacturing a flat structure useful as a reinforcing surface in a building element made of a composite material with aligned layers of individual filaments. The invention provides for individual filaments to be interrupted by a subsequent treatment.

6 Claims, No Drawings

PROCESS FOR MANUFACTURING A FLAT ELEMENT WITH INTERRUPTED MULTIFILAMENTS

The invention relates to a method for producing a sheetlike element composed of unidirectional filaments according to the preamble of the main claim.

The invention relates, furthermore, to a sheetlike element according to the preamble of claim 5.

Unidirectional filaments or reinforcing filaments having directed thread plies at specific angles, for example 0°, 90°, +45°, −45° or other angles, are known for plastic parts subjected to high load. The reinforcing filaments may be composed of glass, carbon, aramide or other synthetic materials. However, the outstanding strength properties of reinforcing sheets of this type which are produced from directed filaments have the advantage that it is difficult to reshape the reinforcing sheet before or during further processing. In many cases, the filaments used do not allow direct reshaping.

The object on which the invention is based is to provide a method, by means of which sheetlike elements composed of directed filament plies nevertheless have good reshapability, where appropriate in particular regions only.

The object, on which the invention is based, is achieved by means of the teaching of the main claim.

A correspondingly designed sheetlike element is explained in claim 5.

In other words, it is proposed, by means of the invention, to interrupt the filaments, composed of the specifically arranged thread plies, in an aftertreatment process, that is to say to interrupt the specifically arranged filament extent by needling. This interruption takes place entirely irregularly, in a similar way to the schappe spinning method known to specialists.

In this case, aftertreatment may also take place only in particular regions and also with differing intensity in particular regions.

In the process, different filament lengths are produced, the basic orientations formed in the not yet needled semi-finished product being maintained in controllable fractions. At the same time, eliminating the purely continuous character of the filaments makes the reinforcing material stretchable and therefore makes it suitable for shaping methods, since the interrupted continuous filaments can now slide past one another under stretching stress.

Furthermore, during needling, an additional positive effect is afforded, since further strength is provided here as a result of the partial reorientation of the interrupted filaments into the third dimension.

The method according to the invention is suitable particularly for carbon filaments, because cut fiber mats with a uniform cut fiber distribution, in very high weights per square meter, are possible, here, from the available filament strengths. However, even in the case of relatively low weights per unit area from 300 g/m$^2$, the product according to the invention constitutes mats having an outstandingly uniform fiber distribution.

The invention relates, at the same time, to monofilaments and multifilaments, depending on the instance of use.

What is claimed is:

1. A method for producing a sheetlike element composed of individual unidirectional filaments having directed thread plies, wherein the individual filaments are interrupted by needling in an aftertreatment process, wherein the aftertreatment is carried out on the sheetlike element in particular regions only.

2. A method for producing a sheetlike element composed of individual unidirectional filaments having directed thread plies, wherein the individual filaments are interrupted by needling in an aftertreatment process, wherein the aftertreatment is carried out with differing intensity in particular regions.

3. A method for producing a sheetlike element composed of individual unidirectional filaments having directed thread plies, wherein the individual filaments are interrupted by needling in an aftertreatment process, wherein the individual filaments are interrupted by needling at irregular intervals.

4. A sheetlike element composed of directed filaments resulting from the method of claim 1.

5. The sheetlike element as claimed in claim 4, wherein there is a mixture of monofilaments and multifilaments composed of different materials.

6. The sheetlike element as claimed in claim 5, wherein the mixture is formed from strengthening filaments and from thermoplastic filaments.

* * * * *